United States Patent [19]

Bradley et al.

[11] Patent Number: 4,471,955

[45] Date of Patent: Sep. 18, 1984

[54] METHOD AND APPARATUS FOR DEVELOPING AND HANDLING STACKS OF WEB MATERIAL

[75] Inventors: John J. Bradley; Harvey J. Spencer, both of Green Bay, Wis.

[73] Assignee: Paper Converting Machine Company, Green Bay, Wis.

[21] Appl. No.: 504,624

[22] Filed: Jun. 15, 1983

[51] Int. Cl.[3] ..... B65H 39/02; B65G 47/31; B65G 47/90

[52] U.S. Cl. ..... 270/58; 271/203; 271/270; 198/461; 198/462; 198/412; 198/617

[58] Field of Search ..... 270/58; 271/270, 203; 198/452, 455, 457, 459–462, 419–422, 617, 579, 604–605, 610, 611, 377, 479, 694, 412

[56] References Cited

U.S. PATENT DOCUMENTS

| | | | |
|---|---|---|---|
| 3,445,017 | 5/1969 | Kile | 270/58 X |
| 3,719,267 | 3/1973 | Reist et al. | 271/270 |
| 3,819,173 | 6/1974 | Anderson et al. | 270/58 X |
| 3,827,545 | 8/1974 | Buhayar | 271/203 |
| 3,880,420 | 4/1975 | Martin | 198/462 X |
| 4,007,824 | 2/1977 | Reist | 198/462 |
| 4,245,734 | 7/1981 | Dectschlander | 198/412 |
| 4,283,973 | 8/1981 | Spencer | 198/694 X |
| 4,331,328 | 5/1982 | Fasig | 198/461 |
| 4,367,997 | 1/1983 | Schweingruber | 198/462 X |

FOREIGN PATENT DOCUMENTS

| | | | |
|---|---|---|---|
| 2724980 | 11/1978 | Fed. Rep. of Germany | 198/461 |
| 2098157 | 11/1982 | United Kingdom | 198/461 |

*Primary Examiner*—E. H. Eickholt

*Attorney, Agent, or Firm*—Tilton, Fallon, Lungmus & Chestnut

[57] ABSTRACT

This invention relates to a method and apparatus for developing and handling stacks of web material and, more particularly, to such articles as towels (folded or unfolded), tissues, impregnated non-woven sheets and other relatively flimsy webs which are either normally or desirably provided in the form of a rectangular stack.

16 Claims, 7 Drawing Figures

METHOD AND APPARATUS FOR DEVELOPING AND HANDLING STACKS OF WEB MATERIAL

BACKGROUND AND SUMMARY OF INVENTION

The art of handling and packaging articles such as stacks of toweling has not kept pace insofar as all of the major components of a processing line are concerned. For example, a typical line would start with an unwind stand which is capable of operating at speeds of 3,000 to 4,000 feet per minute. Next the unwound web encounters an embosser. The embosser, even more so than the unwind is an expensive piece of equipment and can be operated without difficulty up to speeds in excess of 2,000 feet per minute. Next, the web may be slit into narrower webs where no speed limitation applies. The webs are then superposed (see, for example, co-owned, co-pending Bradley application Ser. No. 77,298 filed Sept. 20, 1979) to move at right angles and pass through a rotary cutter, again operating without any speed limitation. However, the stacks of web material thus provided are then delivered to cartoning equipment and the current state of the art in delivery systems experiences a speed limitation in the range of 500 to 750 feet per minute. Thus, there is a considerable amount of expensive equipment that is severely under-utilized.

As a consequence of this, many manufacturers of flimsy web material—for example, impregnated non-woven materials—have foregone the advantages of rectangular stacks and instead have rewound the web material into cylindrical rolls. Such a roll is inefficient from the standpoint of packaging because most packaging is in rectangular cartons so there is considerable waste space. However, this is currently justified by the fact that rewinding equipment can operate at speeds well in excess of 2,000 feet per minute so the under-utilization referred to above is not experienced—but at the expense of putting out a less efficient product. Thus, the art was faced with undesirable alternatives which have been resolved by the instant invention.

The invention solves this dilemma by (1) operating the expensive major components, viz., unwind stand, embosser, etc. at near their normal speed in a first linear path and thereafter delivering the rectangular stacks of web material in a second linear path at a much lower speed consistent with the limitations of current delivery and packaging equipment. This is achieved by providing a unique arrangement of machine elements operating in a unique sequence of steps.

According to the preferred form of the invention, this is advantageously provided through developing stacks of superposed, rectangular sheets of web material at a predetermined speed and thereafter advancing the stacks along a first linear path at speeds which are at least equal to the predetermined speed and with the long dimension of each rectangular web in a stack being arranged parallel with the first linear path. Thereafter the stacks are sequentially removed from the first path and transferred sequentially into a second linear path which is angularly related to the first linear path and thereby increasing the space between stacks in the second linear path. Finally, the stacks are sequentially retarded in the second linear path to reduce the spacing between the stacks and are then advanced in the second linear path at a speed less than the predetermined speed. This results in the advantageous handling of stacks for packaging and other equipment subject to a speed limitation while being processed in upstream equipment not subjected to the same speed limitation.

Among the advantages accruing from the invention is the significant one of being able to utilize "upstream" equipment to its potential while producing stacks at a rate compatible with the speed limited delivery and cartoning system. Although the concept of transferring rectangular stacks of web material to an angularly related second path while maintaining the orientation the same as it was in the first path (see, for example, co-owned Spencer U.S. Pat. No. 4,283,953) is known, there was no appreciation of the advantages of retarding the stacks in the second path to handle the same compatibly with existing delivery and packaging equipment. More particularly, the greater gap developed by transferring the rectangular stacks from a first path to a second, angularly related path without changing the orientation was not appreciated or utilized heretofore. More especially, the original orientation of the stacks which is perpetuated in the second path is particularly advantageous because there is provided a broad side of the stack for engagement with the retarding means—this is particularly effective in avoiding interleaving, distortion of the pack, wrinkling, etc., as compared with attempting to retard a stack by abutting the narrower end. Thus, the step of retardation, heretofore unappreciated, not only achieves the advantageous compatible utilization of all of the major components of the line but does it in a way preserving of the original character of the stacks developed in the line.

Other objects and advantages may be seen in the details of the ensuing specification.

DESCRIPTION OF THE DRAWINGS

The invention is described in conjunction with an illustrative embodiment in the accompanying drawing, in which—

DETAILED DESCRIPTION

Figure 1:
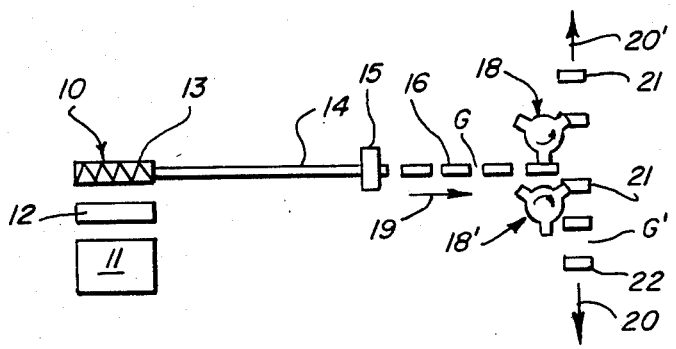
FIG. 1 is a schematic plan view of a production line using a pair of transfer devices according to the invention and discharging product in opposite directions.

Referring now to the drawing and first to FIG. 1, a schematic arrangement of machine components for the production of stacked webs is shown. In this instance, the product is first folded in half and then the sides are folded into the familiar C-folded industrial towel.

The line generally designated 10 includes a four or more wide unwind 11 where a parent roll is supported for unwinding. The web therefrom is passed through an embosser 12 into a slitting-folding section 13. A more detailed description of this arrangement can be seen in the above-referred to Bradley application Ser. No. 77,298.

The line or system 10 produces a continuous stream of four or more ribbons 14. Each of these ribbons is prefolded into a C configuration and the stream then enters a cutoff section 15 as a continuous ribbon.

After cutoff, individual substacks are speeded up by a belt system (not shown) to create a slight gap G between adjacent substacks 16, 17. After being developed by the cutoff, the substacks 16, 17 are controlled by top and bottom pressure entrapment means (24, 25 of FIG. 2) before they enter the transfer devices generally designated 18. The gaps G between consecutive products allow the transfer mechanisms 18 to strip product from between the entrapment means in a direction angularly related to the direction of infeed—the infeed direction being shown by the arrow 19.

In FIG. 1, two transfer devices 18 and 18′ are used to split the stream so that alternate articles are delivered either in the direction of arrows 20 or 20′. Even though the articles 21 and 21′ (in the paths 20 and 20′, respectively) now travel at right angles (as illustrated) to the original infeed direction, they are still oriented in attitude in the same direction relative to the machine frame, i.e., the input path 19. However, the gap G′ between products 21, 22 has now been substantially increased by movement through the transfer device 18 or 18′. As mentioned above, one form of apparatus for developing such a spacing and orientation can be seen in co-owned Spencer U.S. Pat. No. 4,283,973.

Figure 1A:
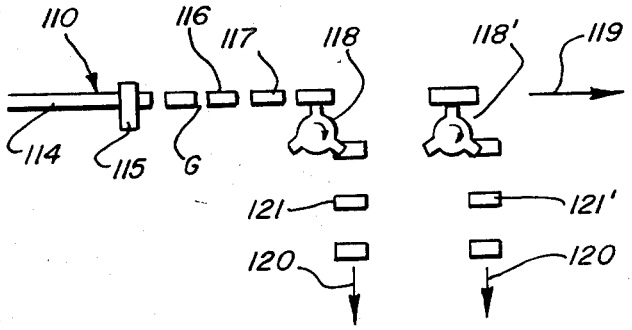
FIG. 1A is a plan view of a similar layout showing two inventive devices operating to deliver product at right angles and in two parallel lines.

In FIG. 1A, a production line generally designated 110 is depicted which is essentially similar to that shown in FIG. 1. Again, a cutter 115 cuts the continuous ribbon 114 into articles 116, 117 separated by gap G. Here, however, the transfer devices 118 and 118′ are arranged on the same side of the infeed path designated 119 and operate to discharge alternate articles 121 and 121′ in two side-by-side streams in the same direction as designated by the arrows 120 and 120′.

Figure 2:
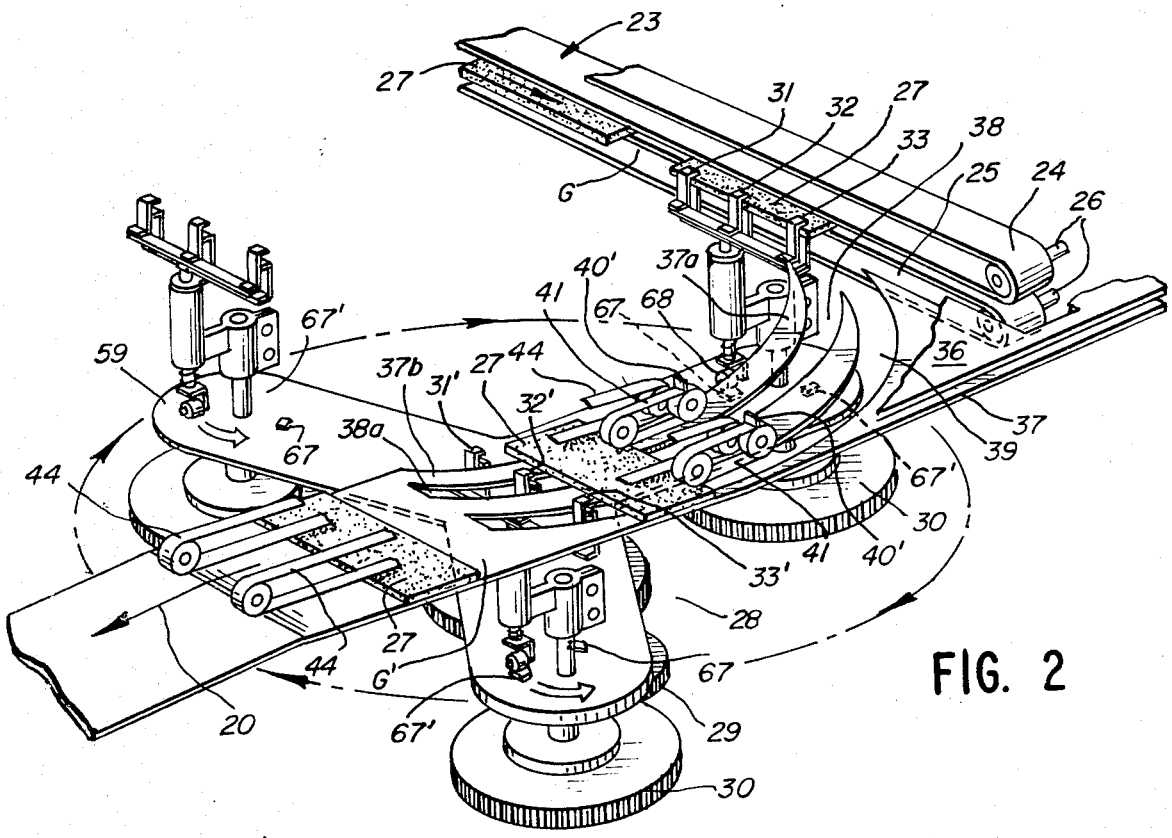
FIG. 2 is a fragmentary perspective view of a transfer device constructed according to the teachings of this invention.
Figure 3:
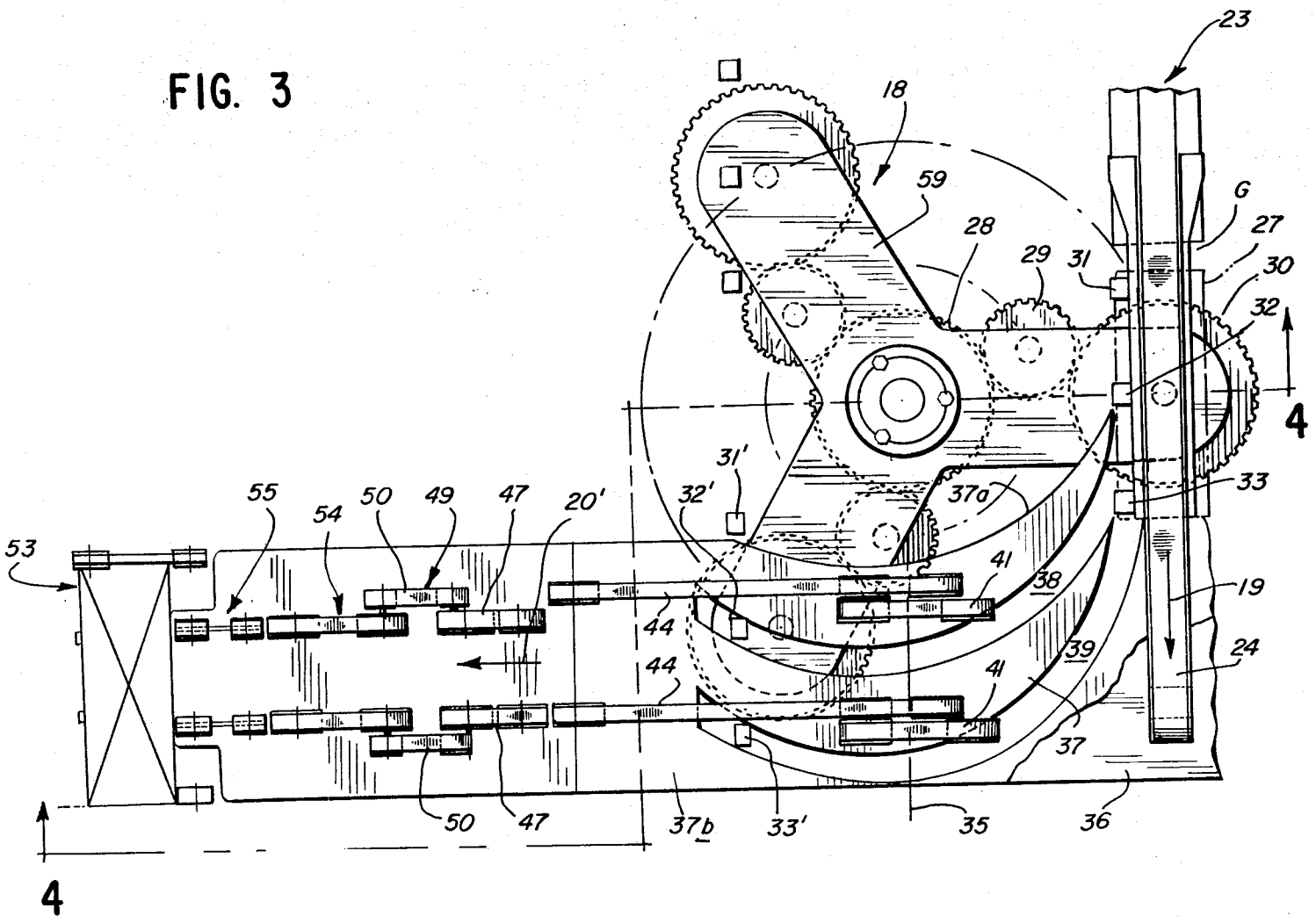
FIG. 3 is a plan view of apparatus constructed according to the invention and showing income and discharge entrapment means.
Figure 4:
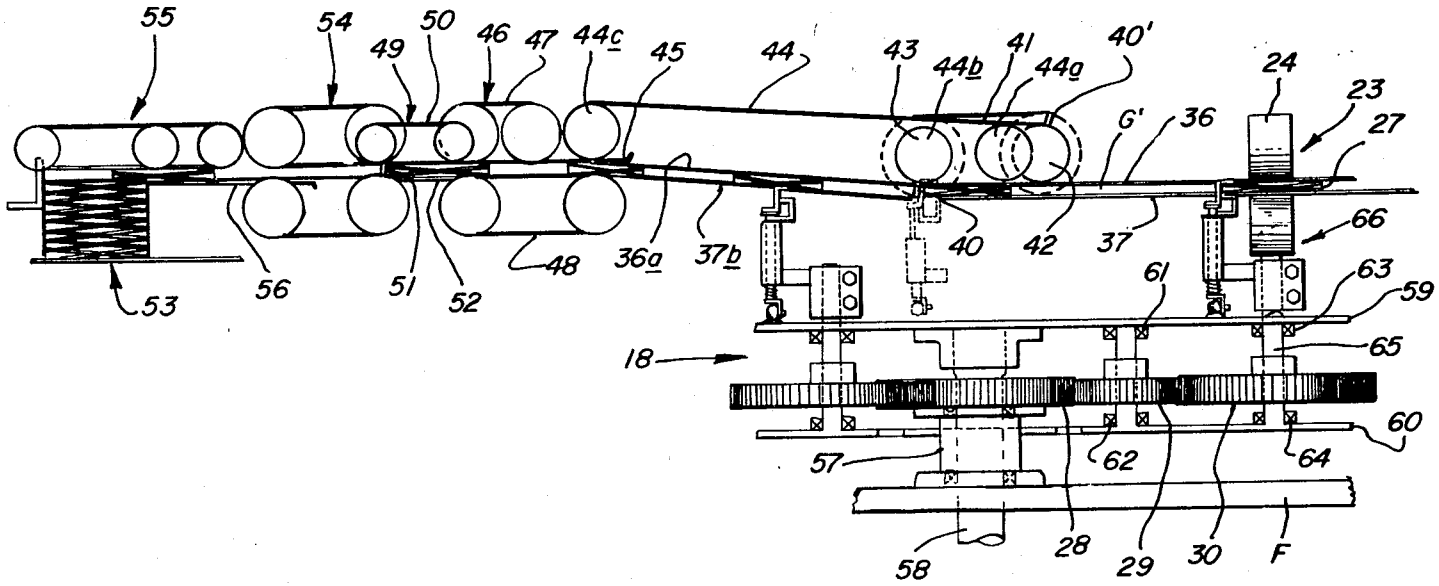
FIG. 4 is a side elevational view taken along the segmental line 4—4 of FIG. 3.

Referring now to FIGS. 2–4, the numeral 23 designates generally an infeed conveyor which, like the remainder of the machinery components to be described hereinafter, is suitably supported on a frame F—seen only in fragmentary form in the lower right hand portion of FIG. 4. The infeed conveyor 23 includes an upper endless belt 24 and a lower endless belt 25 suitably entrained about pulleys as at 26 so as to confine a stack of web material as at 27—see particularly FIGS. 2 and 4. The stack 27 is relatively elongated and is oriented with its long dimension parallel to the direction of travel of the infeed conveyor 23—which thereby defines a first linear path for advancing stacks sequentially, i.e., in a continuous series.

To achieve the 90° transfer illustrated in FIG. 1, the transfer mechanism generally designated 18 (see FIG. (2) employs a planetary gear system consisting of a set of gears 28, 29 and 30 to maintain the stack grippers 31, 32 and 33 (still referring to FIG. 2) in an orientation parallel to the direction of the incoming stacks as shown by the arrow in FIGS. 2 and 3—in the latter view being designated by numerals 19. This orientation or attitude parallel to the length of the first lineal path defined by the arrow 19 persists throughout the arcuate path 34 through which the grippers 31–33 move. A second transfer occurs, in the illustration given, at the end of 90° movement through the arcuate path 34—and at the place indicated by the line 35 in FIG. 3.

When an incoming stack 27 (see FIG. 3) reaches the first transfer point (along the section line 4—4 in FIG. 3), the grippers 31–33 are cam actuated to clamp the longitudinal margin of the stack 27 as seen in FIG. 2. This is the portion that extends beyond the belts 24 and 25. As the grippers rotate clockwise in FIG. 3, the grippers 31–33 travel in parallel circular paths, passing through the plates 36 and 37 (compare FIGS. 3 and 4).

For example, the gripper 31 travels in the path bordered by the curved edge 37*a* (see FIGS. 2 and 3) of the stationary plates 37. Top plate 36 is not shown in FIGS. 2 and 3 for clarity, however proper grooves 38 and 39 allow passage of upper part of the gripper (see FIG. 5) and linear grooves under belts 41 allow for passage of registration lugs 40 and 40′ shown in FIGS. 2 and 4. Other means, such as brushes can be substituted for plate 36. The gripper 32 (the middle one of the three illustrated) travels in a slot 38 (again see FIGS. 2 and 3) provided in the top and bottom plates 36 and 37. Lastly, the gripper 33 travels in yet another slot 39 provided in the plates 36 and 37. The top and bottom plates 36 and 37 provide a continuous support and confinement for the flimsy stack as it travels through the arcuate path.

At the instant the gripped stack 27 reaches line 35 (see FIG. 3), it engages a set of registration or retarding lugs 40 (see FIG. 4), the grippers 31–33 are cam actuated to release the stack 27. A set of companion registration lugs 40′ can be seen in FIGS. 2 and 4 as well. These are provided as part of top belt systems 41 (two side-by-side belts as can be seen in FIGS. 2 and 3). The belts in systems 41 are traveling slower than the stack 27 and therefore retard the same.

EXAMPLE

To illustrate the advantageous practice of the invention, C-folded towels in stacks measuring 11″ long by 4″ wide are advanced by the infeed conveyor 23—and with a between stack spacing or gap of 1″. This results in a center-to-center distance of consecutive stacks of 12″. A typical operating speed for the infeed conveyor 23 is 1500 feet per minute. This makes possible an operating speed of the upstream components of 1375 feet per minute, viz., 11/12th of 1500. As pointed out previously, it is normal practice to have the infeed conveyor 23 operate slightly faster than the upstream components (unwind 11, embosser 12, etc.) so as to develop a small gap between successive stacks 27.

The same center distance of 12″ is maintained after stacks have been rotated into the second lineal path (90° as shown). Now, however, the spacing between stacks is 8″ (compare the gap G of FIGS. 2 and 3 with that designated G′ in FIG. 4).

In the illustration given, the belt systems 41 operate at 1000 feet per minute thereby reducing the speed to two-thirds of that of the infeed conveyor 23. To be described hereinafter is a second retarding belt system which operates at a speed of 500 feet per minute—depicted in the left hand portion of FIGS. 3 and 4—so that the invention now makes possible, in this illustrated embodiment, to operate the upstream components at 1375 feet per minute while the delivery and packaging components operate at 500 feet per minute.

DETAILS OF TRANSFER

Each stack has continuous top and bottom containment which is an effective protection against the effect of windage—the tendency of sheets in a moving stack tending to become detached or at least shift due to the movement of the stack through the air. At the outset, the stacks 27 are confined between the top and bottom belts 24 and 25. This is effective even as the grippers 31–33 grip the stack 27 and begin its arcuate movement in the second linear path. The stack remains intact, even in the most egregious form of C-folded towels. In such a case, the gripper 31033 which grip the stack athwart one of its vertical sides, engage only one of the two C-folds. However, the coefficient of friction between the ungripped C-fold and the underlying layer of toweling is sufficiently greater than the coefficient of friction between the ungripped C-fold and the belt 24 so that the stack remains intact and undistorted. In other words, there is no tendency for the ungripped C-fold to unfold—so long as the surface against which it bears is smooth. This "containment" continues even through the ensuing portion of the transfer where the top and bottom plates 36 and 37 have smooth surfaces for confronting the top and bottom layers of the stack. Because the top and bottom plates are smooth, there is no restraint offered thereby to the stack when it is being advanced by the top belt systems 41. This affords a smooth takeover by the top belt systems 41 when the grippers 31–33 are released. The top belt systems 41 extend only a relatively short length in the direction of the second linear path, the belts carrying the retarding lugs 40, 40′ being entrained about sheaves 42 and 43 (see the upper right portion of FIG. 4). Until the next stage of speed reduction, the stacks are under the control and influence of takeover top belts 44 (see FIGS. 3 and 4). However, the stacks are still confined between the top and bottom plates 36 and 37.

As can be appreciated from FIG. 4 in the extreme left hand portion of FIG. 2, the portion of the second linear path controlled by the top belt system 44 is inclined slightly upwardly—to permit the unobstructed removal of the gripper mechanism. The belts 44 are arranged on sheaves 44*a* and 44*b* (see FIG. 4) which are at the same elevation. The belt systems 44 are further supported by another sheave 44*c* which is at a higher elevation—still referring to FIG. 4. In similar fashion, the plates 36 and 37 are upwardly inclined, for example, as at 37*b*. The slots 38 and 39 terminate just short of the downstream end of the inclined section 37*b* as can be appreciated from a consideration of FIG. 3. This is sufficient for the grippers to move out from under the bottom plate inclined portion 37*b*.

At the end of the inclined section, the stripper plate 45 insures continuity of entrapment as the stack moves forward and containment between a further belt system generally designated 46 consisting of a pair of top belts 47 and a pair of bottom belts 48.

At this point, the stack enters another speed reducing system generally designated 49 which includes a pair of top belts 50 equipped with lugs 51 (see FIG. 4) operating in conjunction with a bottom plate 52.

The stack exits from the second stage slowdown system 49 and is then conveyed to downstream stacking means generally designated 53 via a belt system generally designated 54 (two pairs of upper and lower belts) and a further belt system generally designated 55 which operates in conjunction with a bottom plate 56.

PLANETARY DRIVE

Referring now to the right hand portion of FIG. 4, the frame F is equipped with a bearing housing 57 which rotatably supports the main drive shaft 58. For convenience of illustration, the means for driving the shaft 58 are omitted. The shaft 58 carries an upper plate 59 and a lower plate 60 which rotate therewith. The housing 57 also has affixed thereto the main gear 28 of the planetary drive. The upper and lower plates 59 and 60 (as can be appreciated from FIGS. 2 and 3) are, in effect, a three-legged turntable and support the various planetary gears. As can be seen most clearly in the right hand portion of FIG. 4, the intermediate gear 29 is supported between the plates 59 and 60 by suitable bearings as at 61 and 62. In like fashion, the planetary gear 30 is supported between bearings 63 and 64. The shaft 65 carrying the gear 30 extends through the upper plate 59 and carries a superstructure generally designated 66 (seen in greater detail in FIGS. 5 and 6) which in turn carries the grippers 31–33.

As illustrated in FIG. 3, the grippers 31–33 remain in the same attitude relative to the first lineal path 19 throughout their rotation—as can be seen from the position designated 31′, 32′ and 33′ (at about the 7 o'clock position in FIG. 3). The first transfer in FIG. 3 occurs at what might be considered the 3 o'clock position.

SUPERSTRUCTURE FOR GRIPPERS

Figure 5:
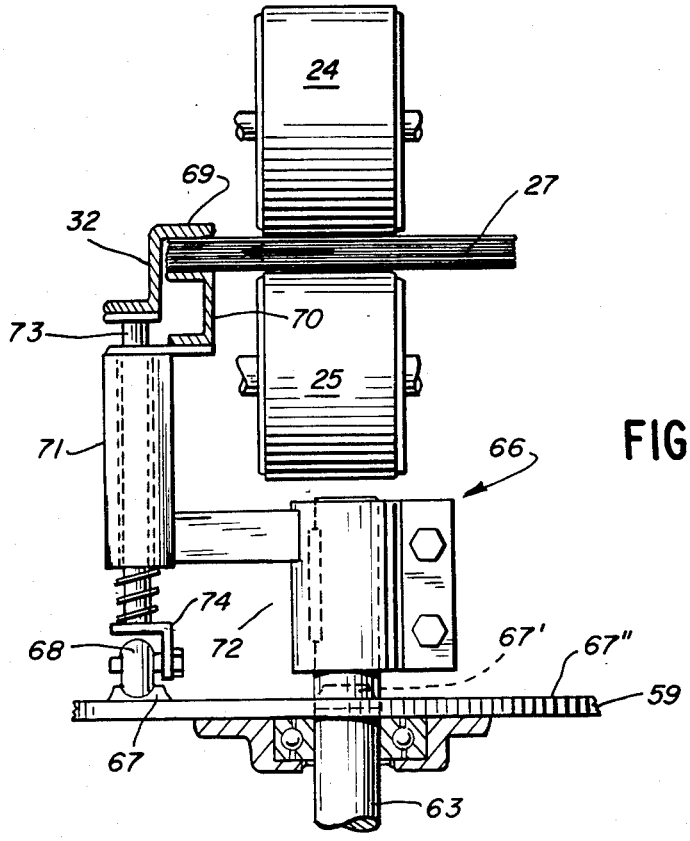
FIG. 5 is an enlarged side elevational view of the gripper device at the product infeed position and at the beginning of transfer.

FIG. 5 is an enlarged view of the gripper operating mechanism shown at the infeed position, i.e., at the instant it grips the stack 27 to begin its arcuate transfer and orientation. It will be appreciated that the gripper mechanism, i.e., the superstructure generally designated 66 does not rotate relative to the machine frame 24 but that a circular cam 67 (carried by the top surface of the top plate 59) rotates relative to the machine frame as the transfer device 18 rotates. Hence, there is relative motion between a cam follower 68 and the cam surface 67. This is responsible for the up and down movement of the movable upper arm 69 of the gripper 32, the lower arm or jaw 70 being immovable in a vertical direction.

The bottom arm or jaw 70 is rigidly fixed to a sleeve 71 which in turn is carried by a bracket 72 fixed to the planetary gear through shaft 63. The sleeve 71 also slidably supports a rod 73 which carries the upper arm or jaw 69 and at its lower end a spring loaded bracket 74 rotatably supporting the cam follower 68.

As can be appreciated from the lower right hand portion of FIG. 2, the cam follower 68 has just passed the cam 67 and is thus in its "gripping" mode. The cam 67 is only employed to raise the upper jaw 69 so as to permit the gripper 32 to straddle the stack 27. Once the upper and lower jaws 69 and 70 are in position for gripping the stack 27, the cam 67 terminates, i.e., has no appreciable length, and the rod 73 descends under the influence of the spring on the spring loaded bracket 74. Thus, the cam 67 serves only the function of opening the gripper 32 at the instant of engagement of the stack 27 by the gripper 32.

90° later, a second cam 67′ engages the cam follower 68 to elevate the upper jaw 69 to the position 69′ seen in FIG. 6, and after stack slowdown, jaw 69 is allowed to drop for clearance under inclined plate 37*b*.

OPERATION

A parent roll of paper or other web material is unwound at 11 in FIG. 1, past through an embosser 12 and then slit and folded as at 13. This results in a number of superposed plies of web material, depending upon the width of the jumbo roll in the unwind 11.

The superposed continuous plies are then transversely severed by a cutoff device 15 and introduced into a speed-up conveyor as at 23 in FIG. 2. This results in providing a slight spacing or gap G between successive stacks 27. The belts 24 and 25 of the speed up conveyor 23 are slightly narrower than the stacks 27 providing the overlapping edge portion which can be gripped by the grippers 31–33 (still referring to FIG. 2). This gripping is illustrated in FIG. 5 relative to the gripper 32. The gripping is achieved through the coaction of upper jaw 69 and the lower jaw 70. The upper jaw 69 is vertically movable and is moved out of gripping relation when the cam follower 68 engages the cam 67 on the transfer mechanism 18. As can be appreciated from a consideration of FIG. 5, the cam 67 has just passed the cam follower 68 so that the upper jaw 69 is in its lower, gripping condition.

The three grippers 31–33 are provided as part of a turntable and move the now gripped stack through a 90° orbit—while the stack is confined between upper and lower plates 36 (not shown) and 37—see FIG. 4. The plates 36 and 37 are slotted as at 38 and 39 to accommodate the passage there through of the grippers 32 and 33. As can be seen from FIG. 3, the gripper 31 passes alongside the curved edge of the plates as indicated at 37*a*.

Figure 6:
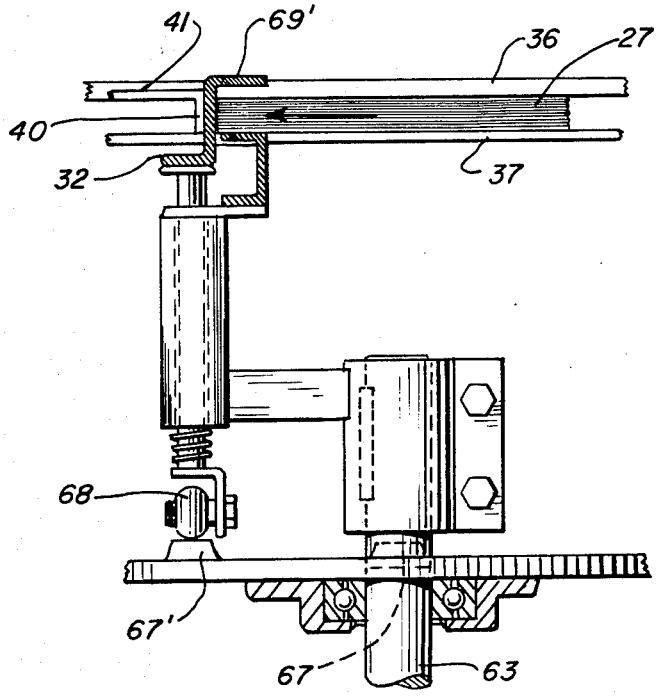
FIG. 6 is a view similar to FIG. 5 showing the gripper device as it releases product into control of the discharge conveying means.

When the stack reaches the position designated 35 in FIG. 3, the grippers release the stack by moving into the configuration seen in FIG. 6. There the cam follower 68 is elevated by engaging cam 67' so as to raise the upper jaw designated 69' in FIG. 6. At the same time the jaws release the stack 27, the stack is engaged by the top belt system 41 (see particularly FIG. 2). This belt system is equipped with retardation or registration lugs 40 and 40'. The retardation belt systems 41 are operating at a substantially slower speed than the outfeed conveyor 41 and thus effect a slowdown of the product being transferred from the first linear path defined by the infeed conveyor 23 to the second linear path defined in part by the retardation belt systems 41. More particularly, in the illustration given, the second linear path is indicated by the arrow designated 20 in FIGS. 2 and 3.

The stack, as can be appreciated from a consideration of FIG. 1 is oriented in the same fashion in this second path as it was in the first path—taken with respect to the machine frame. In other words, the stack has not turned about its own center as it has passed through the 90° arc illustrated. This results in providing a significantly greater spacing or gap G' between successive stacks in the second path.

In one illustration of the invention, the infeed conveyor 23 operates at 1500 feet per minute with 11" long stacks of toweling spaced on 12" centers, i.e., with a gap G of 1". With a stack width of 4" and a speed of the retardation belt systems 41 of 1000 feet per minute, the center spacing is again 12" but the gap now has become 8".

A second retardation system can be provided as illustrated in FIGS. 3 and 4 utilizing the retardation belts 47 and the further belt systems 49 and 54.

In the system shown and directing alternate stacks into separate lanes, the second speed reduction results in successive stacks being 8" on centers with 4" gap therebetween. If preferred, only one diverter as at 18 and having grippers on 12" centers can be used to substantially reduce the gap between successive stacks in a single lane output path.

In the illustrated embodiment, the takeaway mechanism 44 (see particularly FIG. 4) is arranged at a slight incline to the horizontal so as to permit the grippers to pass thereunder in completing their planetary orbit after releasing the stack into the first speed reduction.

While in the foregoing specification a detailed description of an embodiment of the invention involving stacks of sheet material has been set down for the purpose of explanation, many variations of the details hereingiven (as for use with sanitary pads) may be made by those skilled in the art without departing from the spirit and scope of the invention and the claims appended hereto should be so construed.

We claim:

1. In a method for developing and handling stacks of superposed, rectangular webs, the steps of developing said stacks at a predetermined speed and advancing said stacks along a first linear path at speed which are at least equal to said predetermined speed with the long dimension of each rectangular web in a stack parallel with said first linear path, sequentially removing at least some of said stacks from said first linear path to transfer said removed stacks sequentially into a second linear path angularly related to said first linear path while maintaining the long dimension of each rectangular web in a stack parallel to said first linear path to provide a sequence of spaced apart stacks in said second linear path, sequentially retarding each stack in said second linear path to reduce the spacing between successive stacks, and thereafter advancing said sequence of stacks in said second linear path at a second speed less than said predetermined speed whereby said stacks can be handling for packaging in equipment subject to a speed limitation while being developed in equipment not subject to said speed limitation.

2. The method of claim 1 in which said stacks are sequentially removed into at least two second linear paths, each second linear path being angularly related to said first linear path, and retarding and advancing stacks in each of said second linear paths.

3. The method of claim 1 in which following the advancement of said stacks in said second linear path at said second speed, the stacks therein are again sequentially retarded to further reduce the spacing between successive stacks and thereafter are advanced in said second linear path at a speed less than said second speed.

4. The method of claim 1 in which each of said stacks has a pair of longitudinally extending vertical sides and in which each stack is gripped athwart one of said sides, said removing step including passing each stack between spaced apart means to vertically confine the same, said retarding step including abutting said one longitudinally extending vertical side against an abutment moving in said second linear path at said second speed and while simultaneously releasing the grip on the stack at the time of abutment.

5. The method of claim 4 in which said developing step includes C-folding said webs to provide stacks of C-folded towels, said C-folded towels having a greater coefficient of friction between the parts forming the C-fold than that existing between each stack and said spaced apart means.

6. The method of claim 4 in which gripping means are provided to transfer stacks sequentially from said first linear path to said second linear path, said gripping means gripping each stack sequentially at longitudinally spaced apart points, said gripping means moving through an orbit in transferring a stack from said first linear path to said second linear path and thereafter returning to said first linear path to grip a subsequent stack, stacks in said second linear path being elevated while being advanced at said second speed to permit said gripping means to complete its orbit.

7. A method of conveying relatively elongated web stacks comprising:

advancing sequentially a series of said stacks along a first linear path while said stacks are confined between upper and lower belts traveling at a predetermined speed with the stack long dimension parallel to said first path, applying gripping means serially to certain of said stacks along one longitudinal edge and rotating the same through an arc while maintaining the orientation of each stack so that its long dimension when each stack is in said arc is still parallel to said first path, at a predetermined point in said arc serially releasing the clamping of each stack while simultaneously confining each stack being released between a traveling top belt and a bottom plate, said top belt traveling at a second speed less than said predetermined speed and operative to advance a series of said stacks along a second linear path arranged at an angle to said first linear path, and advancing said stacks serially in second linear path at said second speed while elevating said stacks to permit the means for clamping said stacks to pass under said bottom plate while continuing movement in said arc.

8. The method of claim 7 in which said stacks which are being advanced in said second linear path are released from confinement between said top belt and bottom plate while simultaneously being confined between belt means traveling at said second speed.

9. Apparatus for conveying relatively elongated stacks of relatively flimsy material under continuous control comprising:

a frame equipped with a first linear path belt conveyor for advancing a series of said stacks traveling at a predetermined speed and with the long dimension of each stack being parallel to said first conveyor, a turntable rotatably mounted on said frame and equipped with a plurality of equally circumferentially spaced apart clamping devices, means on said frame for rotating said turntable and for selectively actuating and deactuating said clamping devices, said clamping devices being so located on said turntable and said turntable so located relative to said first linear path that said clamping devices are adapted to sequentially engage said certain of said stacks along one longitudinal edge and maintain said certain stacks in the same attitude relative to said first linear path while rotating the same through an arc to a second linear path, and a second belt conveyor on said frame for advancing a series of said certain stacks and traveling along a second linear path disposed at an angle to said first linear path and at a speed slower than said predetermined speed, said means for selectively actuating and deactuating said clamping means being arranged and construced to serially release said stacks when the same are engaged by said second belt conveyor.

10. The structure of claim 9 in which said second path is perpendicular to said first path and alternate of the stacks in said first path are transferred to said second path.

11. Apparatus for developing and handling stacks of superposed, rectangular webs comprising a frame, means operably associated with said frame for developing said stacks at a predetermined speed and advancing said stacks along a first linear path at speeds which are at least equal to said predetermined speed with the long dimension of each rectangular web in a stack parallel with said first linear path, means on said frame for sequentially removing certain stacks from said first linear path to transfer said removed stacks sequentially into a second linear path angularly related to said first linear path while maintaining the long dimension of each rectangular web in a removed stack parallel to said first linear path to provide a sequence of spaced apart stacks in said second linear path, means on said frame for sequentially retarding each stack in said second linear path to reduce the spacing between successive stacks, and means on said frame for therafter advancing said sequence of stacks in said second linear path at a second speed less than said predetermined speed whereby said stacks can be handled for packaging in equipment subject to a speed limitation while being developed in equipment not subject to said speed limitation.

12. The structure of claim 11 in which said removing means includes a turntable having a plurality of equally circumferentially spaced apart gripping members, each gripping member having a plurality of jaws adapted to clamp one of said certain stacks at spaced points along the length thereof, drive means for rotating said turntable and including planetary gear means for maintaining the same attitude of said gripping members while rotating with said turntable, said retarding means including a plurality of spaced apart, lug equipped belts for abutting each certain stack as it enters said second path, said belts being positioned between said jaws.

13. The structure of claim 12 in which said jaws are normally biased to clamping condition, and cam means on said turntable for opening said jaws just prior to each said gripping member approaching said first path and at the time of each certain stack abuts said belt lugs.

14. The structure of claim 13 in which each gripping member includes a spring loaded rod carrying a movable part of said jaws, said rod also being equipped with a cam follower adapted to ride on said turntable, said turntable being equipped with two projections in the path of travel of said cam follower, said projections being circumferentially spaced apart at the same angle as said first and second paths.

15. The structure of claim 12 in which said transfer means includes upper and lower plates extending between said first and second paths, slots in said plates to accommodate the arcuate movement of said jaws and further openings in said upper plate to accommodate engagement of said belts with said certain stacks.

16. The structure of claim 15 in which said plates have an upwardly inclined portion to accommodate passage thereunder of said jaws after releasing said certain stacks.

* * * * *